United States Patent [19]

Goris et al.

[11] Patent Number: 4,658,915

[45] Date of Patent: Apr. 21, 1987

[54] EASY BREAK-OUT TOOL JOINT AND METHOD

[75] Inventors: Gregg A. Goris, Oxnard; Igor Krasnov, Port Hueneme, both of Calif.

[73] Assignee: Vetco Gray Inc., Houston, Tex.

[21] Appl. No.: 805,664

[22] Filed: Dec. 6, 1985

[51] Int. Cl.[4] ..... F21B 17/043; F21B 19/16

[52] U.S. Cl. ..... 175/57; 175/320; 166/77.5; 403/343; 285/333; 285/89

[58] Field of Search ..... 175/85, 320, 256, 203, 175/57; 166/242, 377, 379, 77.5; 285/81, 89, 92, 922, 333, DIG. 23; 403/343, 320

[56] References Cited

U.S. PATENT DOCUMENTS

| | | | |
|---|---|---|---|
| 2,708,132 | 5/1955 | O'Neil | 285/81 X |
| 3,463,247 | 8/1969 | Klein | 285/333 X |
| 3,915,244 | 10/1975 | Brown | 175/85 |
| 4,534,585 | 8/1985 | Saliger | 285/89 X |

FOREIGN PATENT DOCUMENTS

| | | | |
|---|---|---|---|
| 1157568 | 11/1963 | Fed. Rep. of Germany | 285/333 |
| 563155 | 8/1944 | United Kingdom | 285/92 |

*Primary Examiner*—Stephen J. Novosad
*Assistant Examiner*—David J. Bagnell
*Attorney, Agent, or Firm*—Joseph R. Dwyer

[57] ABSTRACT

An easy break-out tool joint (10) (two embodiments) comprising a drive spindle (stem), or sub (12, 12*a*) having a shoulder ring (32, 32*a*) whose shoulder (34) is axially movable but rotatable with the sub (12, 12*a*) to form a conventionally shouldered (34, 58) drill pipe joint so that, upon rotation in one direction, torque is applied in the conventional manner for drilling or back reaming. The shoulder (34) is initially axially moved relative to the drive sub to disconnect the shoulder (34, 58) when the drive stem is rotated in the opposite, or break-out direction, thereby reducing the torque required for break-out to only that torque necessary to unthread the joint. In the practice of the method of triple back reaming utilizing this easy break-out tool joint, a drilling unit (140, 160) is lowered to the platform and the drive spindle or sub (12, 12*a*) is connected to the top drill pipe of the string, while the string is held by a spider (156) at the platform level. The string is then rotated as the drill pipe string is withdrawn from the well bore. When the last of the joints in the stand (three lengths of drill pipe) is above the spider (156), the raising and rotation of the drill pipe string is stopped and the drill pipe string is then held by spiders (156). At this, the drive stem (12, 12*a*) is powered to break-out the joint at the top of the stand. Thereafter, the stand is still held by the rig elevators and appropriate tongs (162, 164) are applied to break the joint at the platform level, thus freeing the stand for movement out of the rig drive axis. The above procedure is repeated until the drill pipe string has been withdrawn.

20 Claims, 18 Drawing Figures

Fig. 7a. (PROJECTED VIEWS)

EASY BREAK-OUT TOOL JOINT AND METHOD

BACKGROUND OF THE INVENTION

This invention relates to an improvement in tool joints by which tubular members, such as drill pipes used in drilling oil and gas wells, are disconnected with less torque and is directed to the application of disconnecting a plurality of lengths of drill pipe, such as three lengths of pipe, or a unit of three pipe lengths, also referred to as a "stand" or "triples," to improve "triple back reaming" where "triple back reaming" is the preferred method of withdrawing a string of drill pipe out of a well bore, whether offshore or onshore. Reaming is accomplished by the drill pipe as it is being rotated and withdrawn.

It is to be understood that this invention improves the method of breaking out a stand of drill pipe by reducing the torque at one selected joint, but it also will be apparent to those skilled in the art that this invention has other applications. To facilitate disclosure, however, this invention is being described in connection with, and as an improvement of, the method of triple back reaming as an example of one application of this invention.

Back reaming in triples is today a preferred method of withdrawing a string of drill pipe from a well bore in those systems where rotating power is applied from above the platform, such as in the rigs utilizing the power drilling unit (top drive unit) of the U. S. Pats. to Boyadjieff Nos. 4,421,179; 4,437,524; 4,449,596 and 4,458,768 or the side drive system of Krasnov as disclosed and claimed in the copending U.S. application for patent Ser. No. 762,507, filed Aug. 5, 1985 and entitled "Side Drive Drilling."

Thus, in back reaming in triples, the drive spindle, or drive stem, is connected to the top of the three lengths of drill pipe being held by the spider at platform level and then is gradually raised by the traveling block on the drilling unit as the drill pipe is rotated until the lower joint of the three drill pipe lengths is above the platform. Rotation of the drill pipe is in the same direction in reaming as in drilling. Then, drill pipe rotation is stopped and the top pipe length of the next drill pipe length of the string is held by the spiders. Next, the break-out tongs and backup tongs break-out the lower joint of the stand of pipe. Later, a power tong on the drill unit is also used to disconnect the drive spindle from the top drill pipe length. Thereafter, the stand of pipe is then moved to one side of the drilling axis by the rig elevator. This procedure is repeated until the entire drill pipe string is withdrawn to the rig. This method of triple back reaming is disclosed in the U.S. Pat. No. 4,449,596, supra.

Because of the torque required to break-out the top joint from the drive spindle, the power tong has to be made part of the drilling unit. Additionally, when a break-out torque is applied to the lower point of the stand, break-out on one of the other three joints may occur first—an obviously undesirable result.

This invention reduces the torque required to break-out the top joint of the stand, thus insuring that the stand will be disconnected at this joint. This invention also eliminates the need for a power tong in the drilling unit.

SUMMARY OF THE INVENTION

The easy break-out tool joint (both embodiments) of this invention comprises a drive spindle (stem), or swivel sub, as the case may be, having a shoulder ring whose shoulder is axially movable but rotatable with the drive stem to form a conventionally shouldered (abutting) drill pipe joint so that, upon rotation in one direction, torque is applied in the conventional manner for drilling or back reaming. The shoulder is initially axially moved relative to the drive stem to disconnect the abutting shoulders when the drive stem is rotated in the opposite, or break-out direction, thereby reducing the torque required for break-out to only that torque necessary to unthread the joint. This reduction in torque ensures the break-out to occur at the top of the stand, i.e., the selected joint. This torque reduction is about one-half the torque otherwise required to break-out the joint between drill pipes.

In the practice of the method of triple back reaming utilizing this easy break-out tool joint, a drilling unit is lowered to the platform and the drive stem is connected to the top drill pipe of the string, while the string is held by the spider at the platform level. The string is then released and rotated as the drill pipe string is withdrawn from the well bore. When the last of the joints in the stand (three lengths of drill pipe) is above the spiders, the raising and rotation of the drill pipe string is stopped and the drill pipe string is then held by spiders. At this time, the drive stem is powered to break-out the joint at the top of the stand using back-up tong on the rest of the drill string. Thereafter, the stand is still held by the rig elevators and appropriate tongs are applied to break the joint at the platform level, thus freeing the stand for movement out of the rig drive axis so that the drive stem may be lowered and connected to the top drill pipe near the platform. The above procedure is repeated until the drill pipe string has been withdrawn.

DETAILED DESCRIPTION

Figure 1:
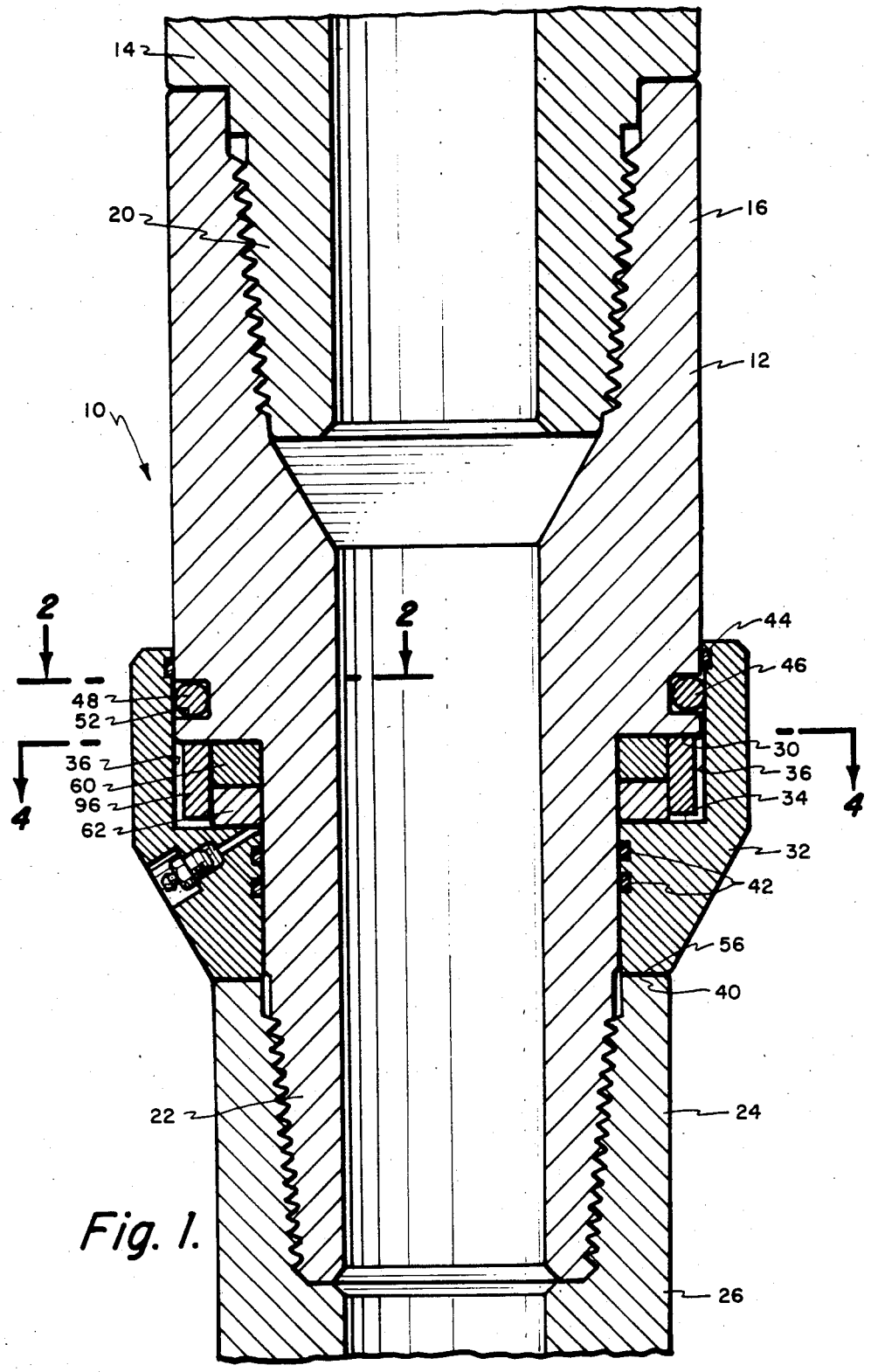
FIG. 1 is an elevational cross-sectional view of the easy break-out tool constructed in accordance with the teachings of this invention.

In the drawings, the easy break-out tool joint is identified in its entirety as 10 and is shown to include a hollow, cylindrical tubular member 12 which, in the embodiment shown, is a swivel sub, or "sub," adapted to be connected to a drive spindle (drive stem) 14 of the drilling unit by a conventionally tapered internal threaded box 16 and tapered externally threaded pin 20 of the stem. The tubular member may also be the drive spindle itself, if desired. The other end of the sub is provided with a tapered externally threaded pin 22 to be connected to the tapered externally threaded box 24 of a drill pipe 26. The sub 12 and drill stem 14 are hollow, like the drill pipe, for drilling fluids, etc.

The sub 12 is provided with a downwardly facing shoulder 30 forming a portion of lesser diameter and on which is telescoped a shoulder ring 32. The shoulder ring 32 is provided with an upwardly facing shoulder 34 spaced from the lower facing shoulder 30 on the sub 10 to define a cylindrical peripheral ring cavity 36. The shoulder ring is thickest at its lower portion and conically tapers to a downwardly facing end shoulder 40 while the upper or thinner portion telescopes over the thicker portion of the sub. Suitable 0-ring seals 42 and a junk seal 44 are appropriately located to maintain the ring cavity 36 as clean as possible and to maintain a pressure seal from the internal drill fluids.

Figure 2:
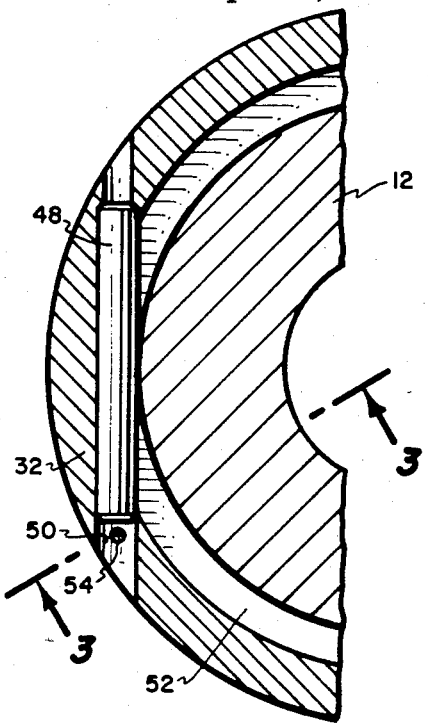
FIG. 2 is a partial cross-sectional view taken along line 2—2 of FIG. 1.

The shoulder ring 32 is connected to the sub 12 in such a manner that a limited relative axial movement of the shoulder ring is permitted. This connection of the shoulder ring 32 to the sub 12 comprises a pair of retainer pins 46 and 48 located in transverse, straight, bores (bore 50 shown in FIG. 2) in the shoulder ring which tangentially engage a peripheral groove 52 in the sub (FIG. 2), above the ring cavity 36. The retainer pins are retained in place by cotter pins; only one being shown in FIGS. 2 and 3 and designated 54.

As shown in FIG. 1, the drill pipe 26 is shown bottomed out, i.e., has an end shoulder 56 engaging (abutting) the downwardly facing end shoulder 40 of the shoulder ring 32. This position of the drill pipe is conventional and a shoulder similar to shoulder 56 would engage a shoulder, such as 40, on the lower end of the drill pipe in a similar manner to form the conventional drill string.

As stated above, it has been determined that the break-out torque required to break-out the connected pipe joints is about evenly divided between the friction of the threads and the friction of the abutting shoulders and this invention reduces the torque requirement for break-out by eliminating or greatly reducing the break-out torque of the abutting shoulders. How this is accomplished will now be described.

Figure 3:
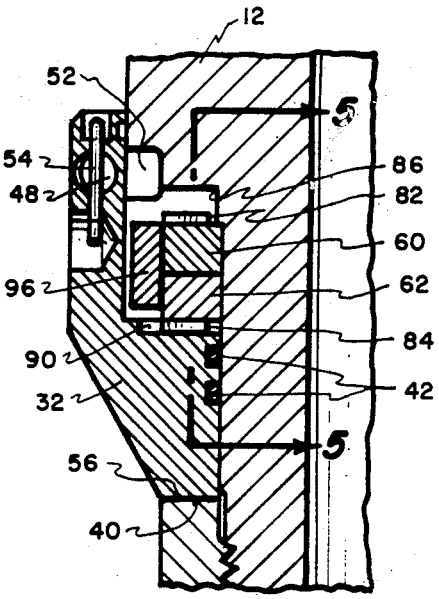
FIG. 3 is a partial elevational view taken along line 3—3 of FIG. 2.
Figure 6:
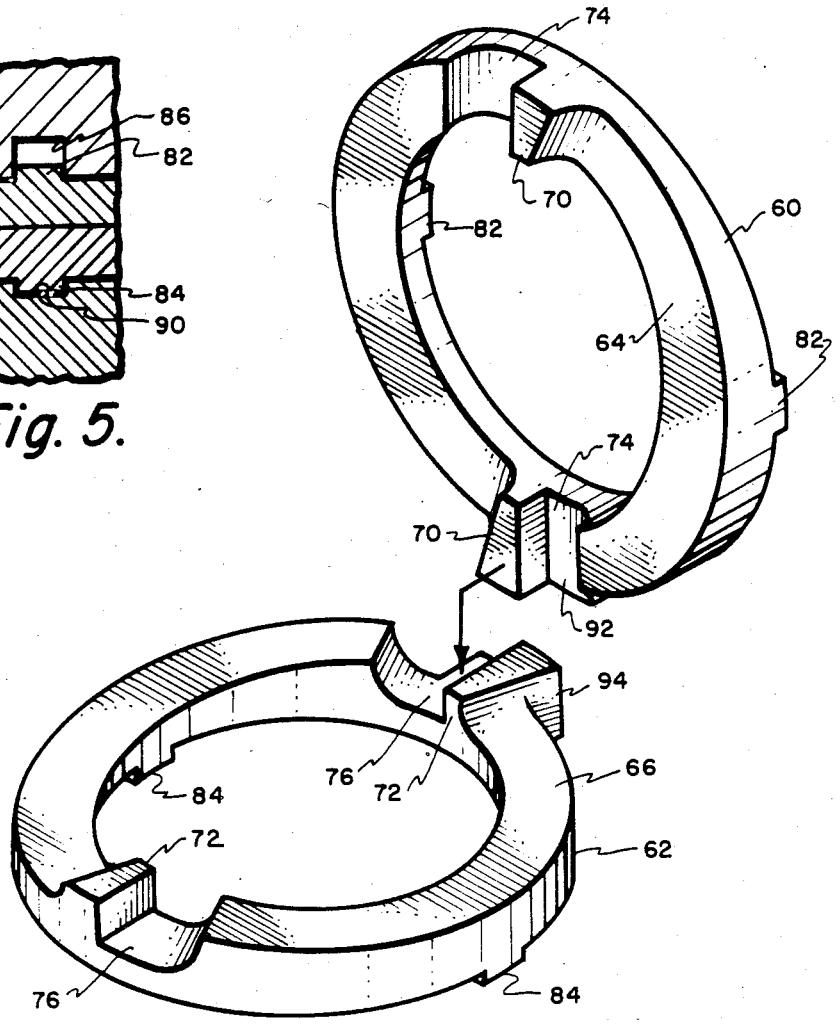
FIG. 6 is a perspective view of the rings of the easy break-out tool, FIG. *7a* and *7b* are projected or layout views of the rings of FIG. 6, showing the rings in two positions.
Figure 7B:
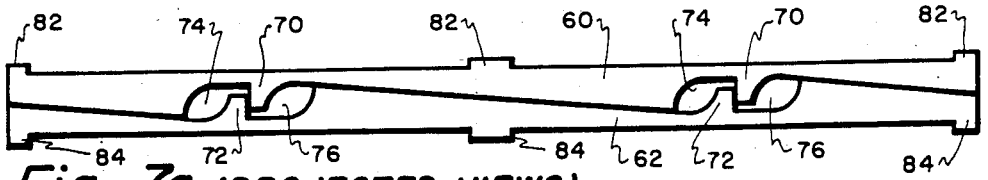
Figure 7B:
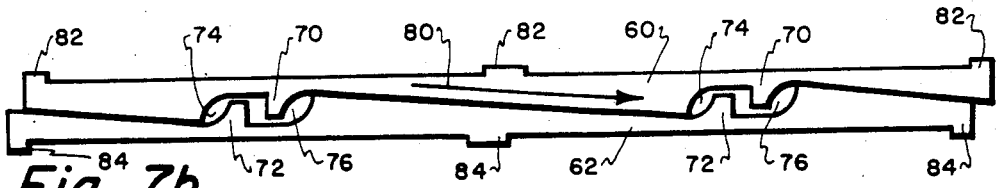
Figure 8:
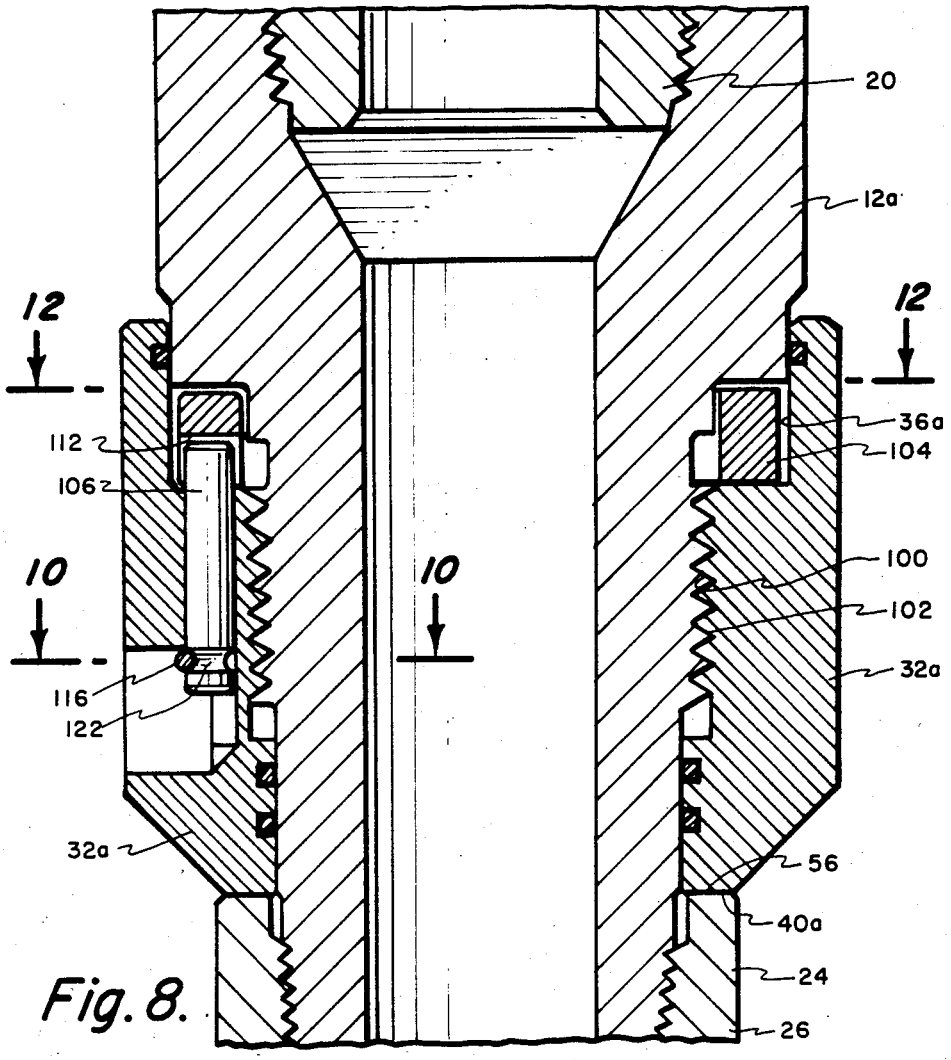
FIG. 8 is a elevational cross-sectional view, like FIG. 1, but showing a second embodiment of the invention.
Figure 9:
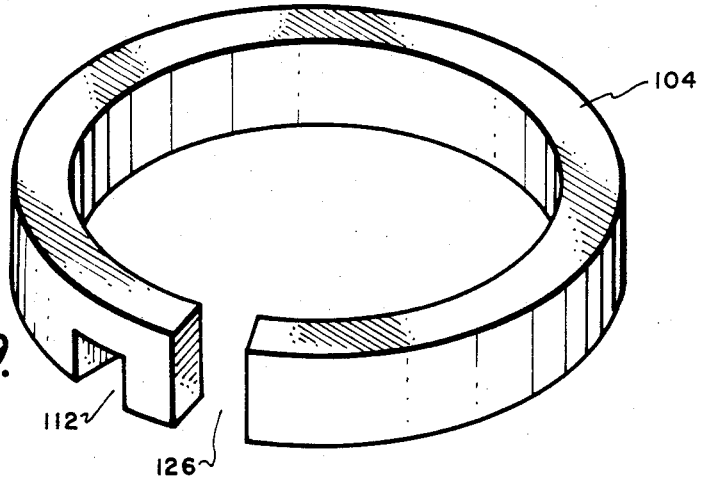
FIG. 9 is a perspective view of a ring used in this second embodiment.
Figure 10:
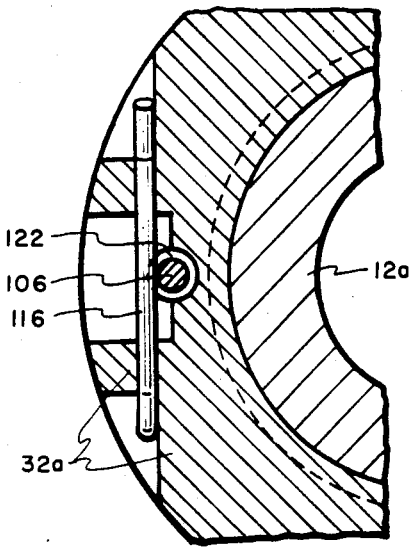
FIG. 10 is a partial cross-sectional view taken along line 10—10 of FIG. 8.

As shown in FIGS. 1 and 3, within the ring cavity 36, are a pair of rings 60 and 62 which inter-engage and, in their normal or expanded condition, engage the downwardly and upwardly facing shoulders 30 and 34 of the sub and shoulder ring, respectively. These rings 60 and 62 are best shown in FIG. 6 and, as seen in the projected views of FIGS. *7a* and *7b*, the pair are provided with pairs of complimentary helical surfaces 64 and 66 (shown as simply inclined planes or ramps in FIGS. *7a* and *7b*). The angle of the inclined planes is approximately 4° from horizontal. Ring 60 is provided with vertical shoulders 70 which engage vertical shoulders 72 of the other ring 62 to prevent relative rotation in one direction. Pairs of cavities 74 and 76 allow relative sliding movement on the helical surfaces of the rings in the opposite direction. These shoulders and cavities are located near the end of each helical surface. Thus, the rings 60, 62 will rotate together in their expanded condition in a first or make up direction, (clockwise as viewed from the top of the sub 12) and will allow sliding movement between the rings in the second or break-out direction (counterclockwise as viewed from the top of the sub) by reason of the cavities 74 and 76. This sliding (down ramp) movement lowers the total torque required to break-out the joint, i.e., the down ramp phenomenon requires less torque for a given weight as a function of the friction involved than the straight sliding friction between the two shoulders 40 and 56. This sliding down ramp movement also narrows the combined width of the two rings so that the shoulder ring 32 may be disconnected from the drill pipe shoulder 56 within a partial turn of the sub 12. This narrowing is represented by the arrow 80. In this instance, the shrinkage of the rings and thus, the movement of the shoulder 40 away from the shoulder 56, is about 0.005 inch.

Figure 5:
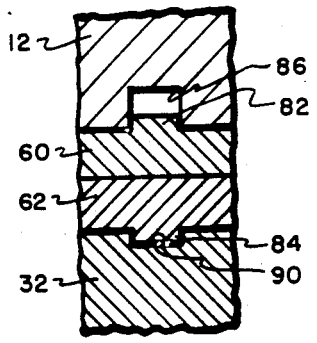
FIG. 5 is a partial elevational view taken along line 5—5 of 3.

In addition to the function of the helical surfaces 64–66, each ring is provided with locating projections, or keys, 82 and 84, respectively, which extend vertically (as viewed in the drawing) and which are disposed within radial slots 86 and 90 in the shoulder ring 32 and in the sub 12. See FIGS. 3 and 5 for a clear view of these slots. These keys maintain each ring against movement relative to their respective components.

Thus, when the sub 12 is rotated clockwise, the joint between the sub 12, together with shoulder ring 32, and the top of the selected drill pipe 26 can be made up in the conventional manner with the two shoulders 40 and 56 bottoming out (engaging) as if the easy break-out tool joint were another drill pipe. In this position, rotation of the sub 12 will drive the drill pipe to perform its function in the conventional manner.

When it is desired to disconnect the sub 12 from the drill pipe 26, i.e., break-out the joint, rotation of the sub 12 in the counterclockwise direction will cause the two rings 60 and 62 to slide relative to one another, thus lessening their width so that the shoulder 40 engaging the drill pipe shoulder 56 becomes disconnected.

Figure 4:
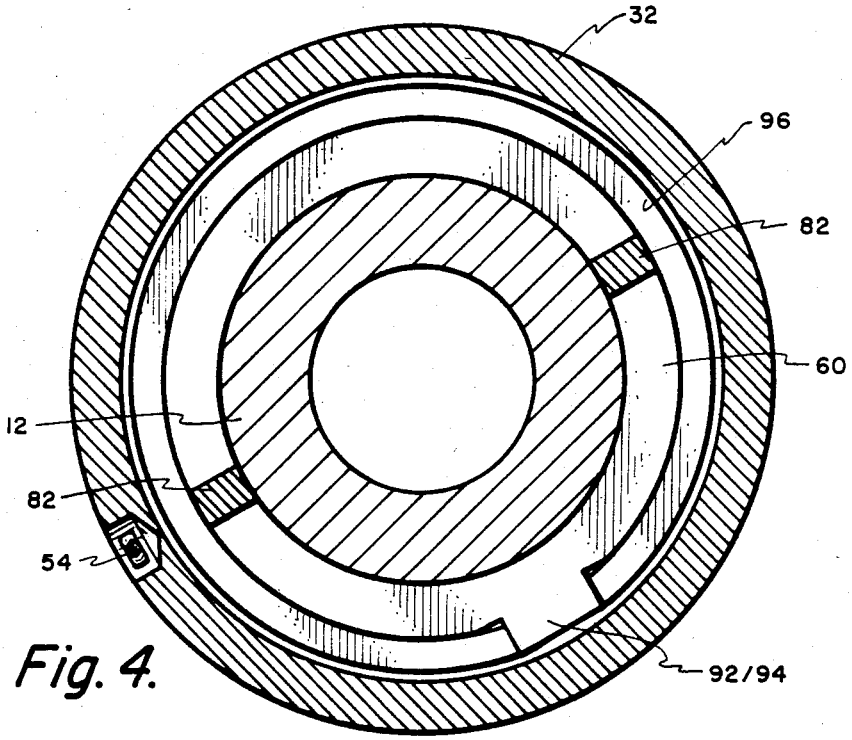
FIG. 4 is a cross-sectional view taken along line 4—4 of FIG. 1.

In order to provide this easy break-out tool joint 10 with an automatic resetting feature, the rings 60 and 62 are also provided with a radially outwardly extending reset projections 92 and 94 (in a different plane from the above mentioned keys 82 and 84 and best seen in FIGS. 4 and 6). When assembled, the rings 60 and 62 are surrounded by a split-ring 96, (see FIGS. 1 and 4), also called a "C-ring," which tightly engages the two reset projections 92 and 94. Thus, when the joint is made up, i.e., the sub 12 is rotated in the clockwise direction, the split ring 96 is in its contracted position surrounding the rings. However, when the sub 12 is rotated in the break-out direction, relative movement between the rings 60 and 62 causes the split ring 96 to expand by reason of the displacement of the reset projections 92 and 94 relative to one another. Finally, when the necessary break-out torque has disconnected the two shoulders 40 and 56, the spring action of the split ring will urge the rings 60 and 62 to their original position, thus resetting the tool 10 for another use. The thickness of the split ring 96 is, of course, equal to or slightly less than the thickness of the two rings 60 and 62 at their shrunk position to allow the shoulder ring to move away from the end of the drill pipe 26.

FIGS. 8–12 illustrate a second embodiment of the invention which includes components similar to the above described embodiment and, for those components having a similar function, they are given the same reference numeral but with a suffix small "a" to simplify the description of this embodiment. Those components which are identical will bear the same reference number.

Thus, in this embodiment, the sub 12*a* is provided with a similar pin and box construction 16 and 22 and the box 24 of the drill pipe 26 is shown abutting against the shoulder 40*a* of the shoulder ring 32*a*.

In this embodiment, however, the shoulder ring 32*a* is provided with internal left-hand threads 100 to cooperate with mating left hand external threads 102 on the sub 12*a*. During assembly, the shoulder ring 32*a* is threaded onto the sub counter-clockwise.

Figure 11:
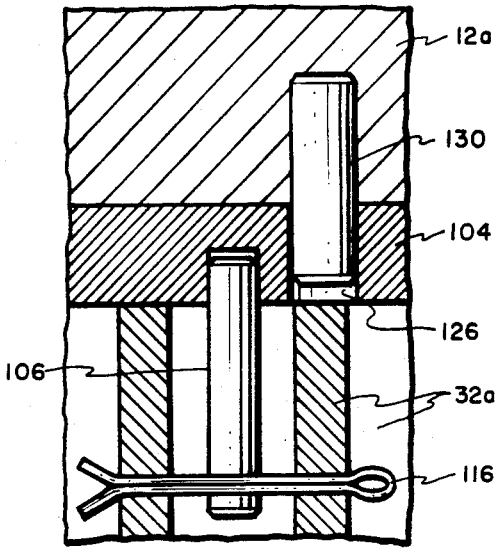
FIG. 11 is an elevational view, in cross-section, taken along line 11—11 of FIG. 12.
Figure 12:
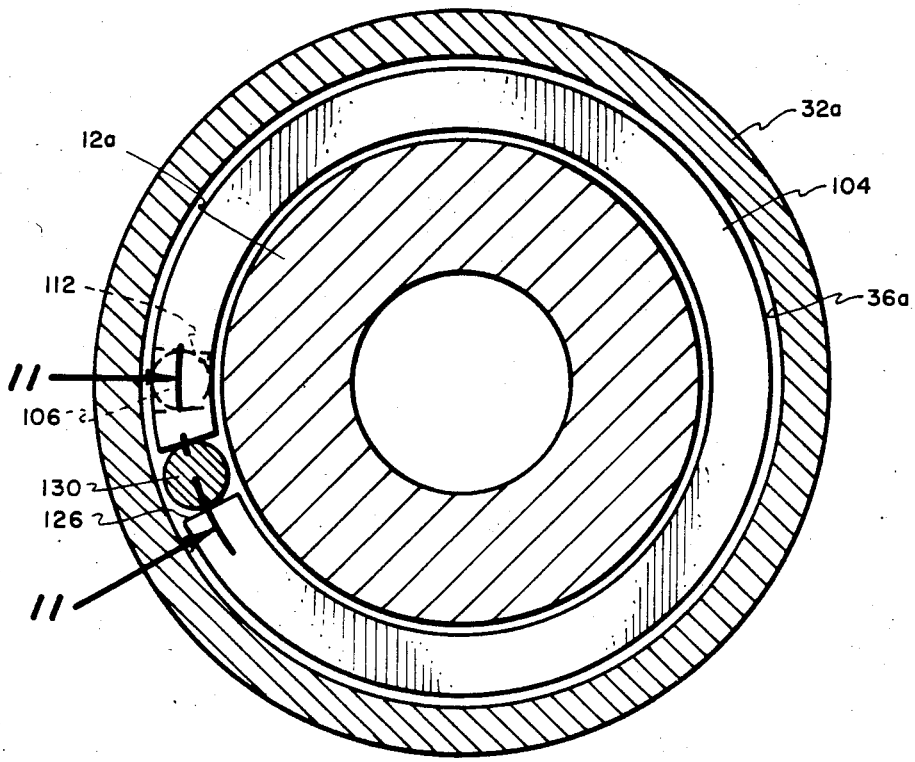
FIG. 12 is a cross-sectional view taken along line 12—12 of FIG. 8.

In this embodiment, also, the cavity 36*a* contains a split ring 104, also called a "C-ring," which is connected to the shoulder ring 32*a* by a pin 106 which engage a slot 112 in the split ring 104. This pin is held in place on the shoulder ring 32*a* by a cotter pin 116 engaging a groove 122 in the pin 106. Positioned centrally, i.e., at the split or space 126 forming the split ring 104 is a third or center pin 130 of a diameter to fill the space 126 and engage the ends of the split ring 104. This pin 130 is connected to the sub 12*a* as shown in FIG. 11. Thus, rotation of the sub 12*a* in a clockwise or make-up direction, the ends of the split ring continue to engage the pin 130 preventing any relative rotation between the sub 12*a* and the shoulder ring 32*a*. However, upon rotation of the sub 12*a* in the counter-clockwise or break-out direction, to break connection with the drill pipe 26, the same pin 130 will cause the split ring 104 to expand. Expansion of the split ring 104 occurs when the shoulder ring 32*a* rotates in the clockwise direction. This rotation is caused by the initial friction resistance to break-out of the abutting shoulders 40*a* and 58. The pins 106 and 130 are attached to the sub 12*a* and the shoulder ring 32*a*, respectively, and each engage opposite ends of the split ring 104. During this expansion, the shoulder ring 32*a* will move upwardly on the threads 100–102. Threads 100–102 function as ramps similar in function to the helical surfaces 64, 66 of the rings 60 and 62 of the first embodiment. Once the required torque to disconnect the two shoulders 40*a* and 56 has been met, the split ring 104 will then cause the tool 10 to reset itself by contracting and causing relative rotation between the shoulder ring and the sub 12*a*.

Turning now to FIGS. 13–17, there is shown schematic illustrations of the method of handling drill pipe in triples utilizing this invention.

Figure 13:
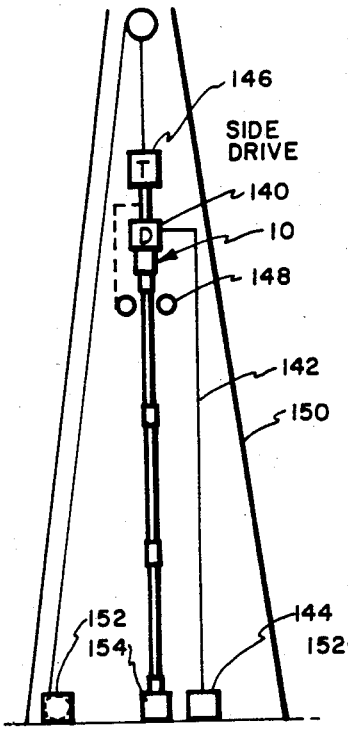
FIG. 13 is a schematic illustration of a side drive in which the easy break-out tool of this invention may be used.

FIG. 13 illustrates the side drive of the Krasnov application, supra, wherein a driven upper kelly bushing 140, driven by a kelly 142 and a motor 144, provides power to rotate the drill pipe string. The driven kelly bushing 140 is raised and lowered by a traveling block 146 which raises and lowers conventional elevators 148 for holding the drill pipe. The traveling block 146 is, of course, connected to the schematically illustrated derrick 150 and to the drawworks 152. A suitable spider mechanism 154, located at the platform level, holds the drill pipe string during break-out, as will be described. The easy break-out tool 10 is shown connected to the driven kelly bushing.

Figure 14:
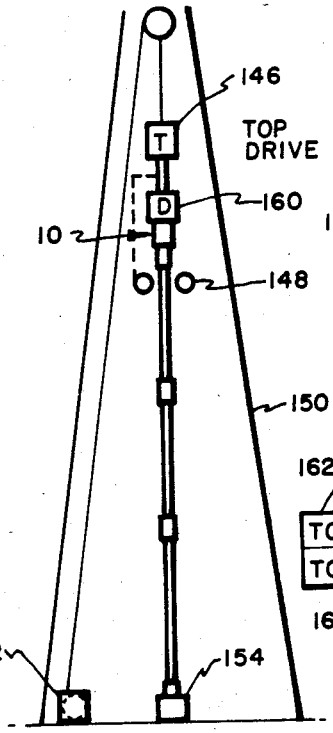
FIG. 14 is a schematic illustration of a top drive in which the easy break-out tool of this invention may be used.

FIG. 14 illustrates the top drive of the Boyadjieff Patents, supra, with a drive unit 160 being raised and lowered by a similar traveling block 146 and is also provided with conventional elevators 148 for holding the drill pipe. Easy break-out tool 10 is also shown connected to the drive unit 160.

Figure 15:
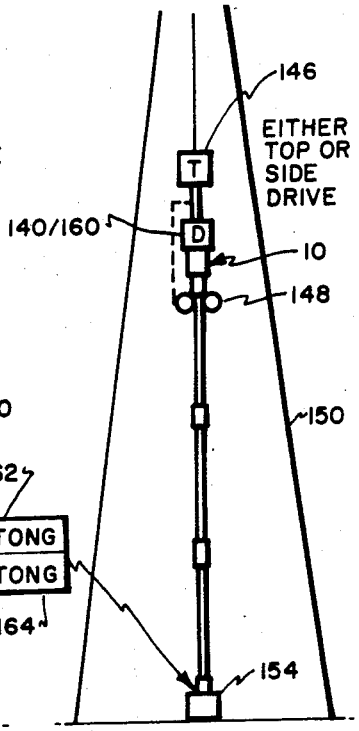
FIG. 15 is a schematic illustration of the use of the easy break-out tool in disconnecting the top of a stand.

FIG. 15 illustrates the use of the the easy break-out tool 10 of this invention for disconnecting the drive stem from the upper drill pipe length as the stand is held by the spiders 154 at the platform level. This disconnection occurs after the drive spindle or sub has been connected with the drill pipe at the platform level and the drill string raised and concurrently rotated until three drill pipe lengths and part of the fourth drill pipe length clears the platform when the fourth pipe length is then held by the spiders. Also illustrated are conventional break-out and back-up tongs 162 and 164.

Figure 16:
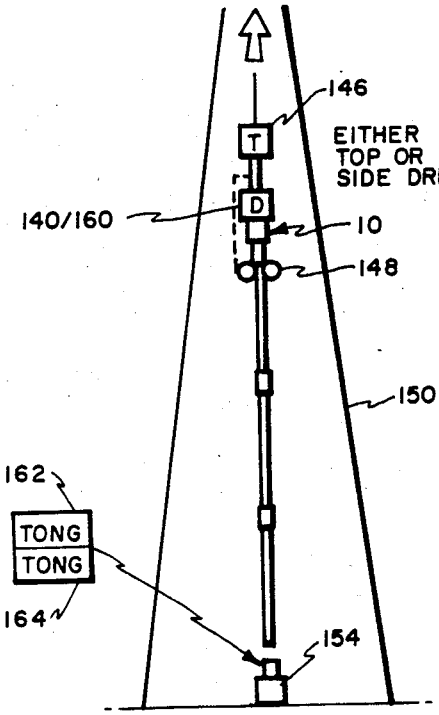
FIG. 16 is a schematic illustration of the stand being broken out at the platform level.

FIG. 16 illustrates the stand being held by the elevators 148 since the stand has now been disconnected at the platform level by the break-out and backup tongs 162 and 164.

Figure 17:
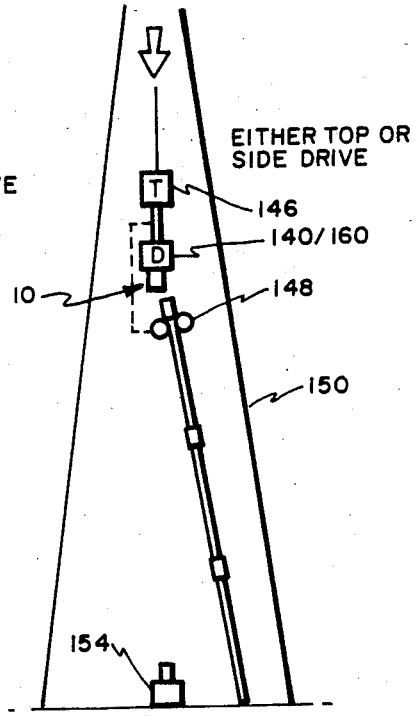
FIG. 17 is a schematic illustration of the stand being moved to the mousehole.

FIG. 17 shows the stand being moved while held by the elevators 148 and placed in a mousehole or racked in the derrick for subsequent use.

Thus, the use of the easy break-out tool 10 of this invention insures that when torque is applied by the driven kelly bushing 140, or the driven unit 160 of the side drive, as the case may be, the top of the stand, and only the top of the stand, will be disconnected by lessening of the break-out torque required at this connected joint, that is, the top joint of the stand.

It can be appreciated that in addition to the foregoing method, this invention may be used wherever it might be desirable to lessen the break-out torque at a selected joint of coupled tubular members.

We claim:

1. An easy break-out tool joint for reducing the torque required to break-out tubular members connected together by torque applying means to form a joint comprising, a first tubular member having a first shoulder means and external threads, thus forming a pin, a second tubular member having an end shoulder means and internal threads, thus forming a box, said pin being adapted to be threaded into said box until said shoulder means engage to form said joint, said first shoulder means becoming part of the torque applying means to rotate said second tubular member when said first tubular member is rotated in one direction, and means for moving said first shoulder means away from said end shoulder means when said first tubular member is rotated in a second direction, thereby lessening the torque required to break-out said joint between the tubular members.

2. The easy break-out tool joint as claimed in claim 1 wherein said means for moving said first shoulder means comprises ramp means between said first shoulder means and said first tubular member.

3. The easy break-out tool joint as claimed in claim 2 wherein said ramp means comprises helical surfaces on rings disposed between said first shoulder means and said first tubular member.

4. The easy break-out tool joint as claimed in claim 1 further including reset means responsive to said moving means to return said first shoulder means to its original position with respect to said first tubular member after said part has been disconnected.

5. The easy break-out tool joint as claimed in claim 4 wheerein said reset means comprises a split ring operatively connected between said first tubular member and said first shoulder means.

6. The easy break-out tool joint as claimed in claim 5 wherein said reset means includes means on said rings which expands said split ring when said first shoulder means is moved and allows said split ring to return to its original position when said joint has been disconnected.

7. The easy break-out tool joint as claimed in claim 2 wherein said ramp means comprises engaging internal and external threads between said tubular member and first shoulder means.

8. The easy break-out tool joint as claimed in claim 7 further including reset means responsive to said moving means to return said first shoulder means to its original position with respect to said first tubular member after said part has been disconnected.

9. The easy break-out tool joint as claimed in claim 8 wherein said reset means comprises a split ring operatively connected between said first tubular member and said first shoulder means.

10. The easy break-out tool joint as claimed in claim 9 wherein said reset means includes means operatively disposed with respect to said split ring to send first tubular member so as to make said split ring responsive to movement of said first shoulder means and means connecting the split ring itself to said shoulder means.

11. The easy break-out tool joint as claimed in claim 10 wherein said means operatively disposed with respect to movement of said shoulder means comprises means disposed in the split of said split ring.

12. The easy break-out tool joint as claimed in claim 11 wherein said last mentioned means operates to cause rotation of said first shoulder means when said first tubular member is rotated in said one direction.

13. Apparatus for drilling and reaming a well bore located below a platform, including a derrick with means for raising and lowering a string of drill pipe from said platform to and from said well bore, whether subsea or on shore, drive means above said platform for rotating said drill pipe string and movable up and down with respect to said derrick, easy break-out tool joint means including threaded pin and box members with first and second shoulder means located at said drive means and adapted to form a joint with the uppermost drill pipe of the string with said first and second shoulder means being engaged for rotating the drill pipe string in one direction for drilling and reaming said well bore, said easy break-out tool means having means for reducing the torque required to disconnect said joint when said drive means is rotated in a second direction by initially disengaging said first and second shoulder means, and means for holding a plurality of drill pipe lengths above said platform while holding the top of the remainder of said string at the lever of said platform, while said plurality of drill pipe lengths are held against rotation.

14. The apparatus as claimed in claim 13 further including means for holding the top of said plurality of drill pipe lengths after said joint has been disconnected and means for disconnecting said plurality of drill pipe lengths from the remainder of said string.

15. The apparatus as claimed in claim 14 further including means for moving said plurality of drill pipe lengths while being held at the top and placing said plurality to one side so that said drive means may be lowered and connected to the top of said remainder of drill string.

16. The apparatus as claimed in claim 15 wherein said plurality of drill pipe lengths comprise three of such lengths.

17. A method of back reaming a well bore located below a drilling platform comprises the steps of:

lowering a drive means including an easy break-out tool to the platform level and connecting said drive means via said easy break-out tool to the top of a drill string located at about the platform level, raising said drive means and said drill pipe string while rotating said string in one direction, stopping the raising of the string and stopping rotation after the lower of a plurality of drill pipe lengths has reached a point slightly above the platform, gripping a drill pipe length located below said lower drill pipe length, rotating said drive means in the opposite direction from said one direction so that easy break-out tool functions to thereby disconnect the topmost of the plurality of drill pipe lengths from said drive means, holding said disconnected topmost drill pipe length, and disconnecting said lowermost drill pipe length from the aforesaid drill pipe length being gripped.

18. The method as claimed in claim 17 further including the step of moving said disconnected plurality of drill pipe lengths out of the axis of rotation of said drill string.

19. The method as claimed in claim 18 further including the step of lowering said drive means and connecting same to the gripped drill pipe length and releasing said gripped drill pipe length to enable said drive means to raise and rotate said drill string.

20. The method as claimed in claim 19 wherein said plurality of drill pipe lengths is three of such lengths.

* * * * *